US006496360B1

(12) United States Patent
Cordes et al.

(10) Patent No.: US 6,496,360 B1
(45) Date of Patent: Dec. 17, 2002

(54) LAPTOP PORTABLE COMPUTER DESK

(75) Inventors: Michael James Cordes, Newburgh, NY (US); Steven Allen Cordes, Cortlandt Manor, NY (US)

(73) Assignee: International Business Machines Corporation, Armonk, NY (US)

( * ) Notice: Subject to any disclaimer, the term of this patent is extended or adjusted under 35 U.S.C. 154(b) by 764 days.

(21) Appl. No.: 08/877,013

(22) Filed: Jun. 16, 1997

(51) Int. Cl.[7] ..... G06F 1/16; A47B 23/00
(52) U.S. Cl. ..... 361/683; 108/43; 248/444
(58) Field of Search ..... 361/683, 680; 108/43; 248/444

(56) References Cited

U.S. PATENT DOCUMENTS 4,518,164 A * 5/1985 Hayford, Jr. ..... 273/148 B
5,127,339 A * 7/1992 Hood, Jr. ..... 108/43
5,263,423 A * 11/1993 Anderson ..... 108/43
5,623,869 A * 4/1997 Moss et al. ..... 108/43

* cited by examiner

*Primary Examiner*—Lynn D. Feild
(74) *Attorney, Agent, or Firm*—Daniel P. Morris; Alvin J. Riddles

(57) ABSTRACT

A portable computer laptop desk is provided when attached to a structure that in turn is supported on web strapping that passes over the upper legs of the operator when in the seated position. The strapping is attached to foldable and telescopable side and center supports for the structure that slide into and fold over the structure forming a package comparable in size to the portable computer.

9 Claims, 5 Drawing Sheets

4
2
12
3
16
14
10
5
1
13
11
8
6
15
9
21
6
7

13
18
1
11
20
8
18
19
9
21
17
22

LAPTOP PORTABLE COMPUTER DESK

FIELD OF THE INVENTION

The invention relates to portable computers, commonly referred to as the laptop or notebook type, and in particular to an attachment for a portable computer that will provide a stable support for the portable computer on the lap of the user with the portable computer in position for use.

BACKGROUND OF THE INVENTION AND RELATION TO THE PRIOR ART

In the development of computers, particularly of the types known in the art as laptop or notebook, efforts have been directed to providing as many features as possible in a small and light weight package. The most efficient and physically rugged universal package that has evolved in the art is one in which the display screen portion is hinged on the portion of the keyboard away from the user; so that it can be positioned essentially vertical with respect to the keyboard when in use and can be folded down over the keyboard when not in use.

A major advantage of the portable computer is that work can be performed without a specific work location or even a specific supporting surface, which advantage in turn makes possible performing work while traveling on various types of conveyances, and while waiting in terminals. However there are many situations where a person desiring to use a portable computer may not have a stable and comfortable surface on which to position the portable computer. Heretofore in the art, other than sitting with the personal computer on a desk, positioning the portable computer on the lap when the person using it is in a seated position has been the principal way for a user to retain a portable computer while doing work on it. With the personal computer on the user's lap, while work can take place for a while, it is not long before the hands and forearms become tired, the portable computer will require attention to retain it in the proper position during such things as vehicle motion or need for the user to move and it is uncomfortable for the user to hold the knees together and at the same height.

SUMMARY OF THE INVENTION

The invention is a portable computer supporting attachment on which the portable computer is positioned and which in turn supports the portable computer at a level for use on a web strapping harness that passes over the upper legs of the user in the seated position. The supporting attachment is conveniently constructed as a collapsable unit that is close to the size of the portable computer itself. The portable computer is mounted on a structural member with telescopable and foldable properties which in turn is movably supported on a plurality of broad area resilient strap members that pass over the upper legs of the user when the user is in the seated position and which attach to foldable side and center members of the structural member and which are outside and between the legs of the user. The foldable properties of the structural member permits the foldable side and center members and the strap members to fold into a size comparable in thickness to the closed portable computer. The telescopable properties of the structural member permits the side to side dimension of the structural member to be reduced for carrying to slightly greater than the side to side dimension of the portable computer. The portable computer can be removably attached to the top face of the structural member with such means as velcro strips. A wrist support is attached to the structural support member. It is shaped to support the wrist at keyboard level and serves as a carrying handle for the combined personal computer with the telescoped and folded supporting attachment assembly.

DESCRIPTION OF THE INVENTION

Figure 1:
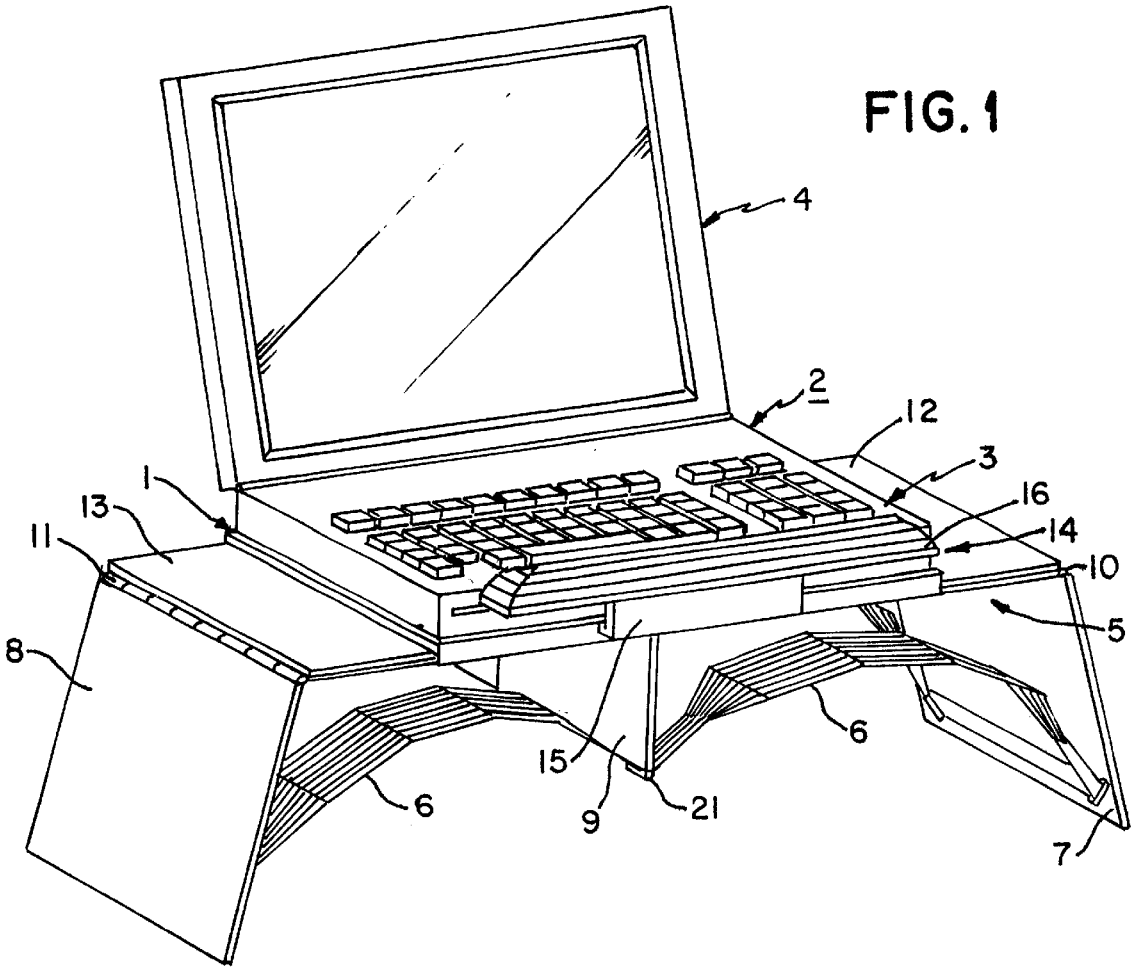
FIG. 1 is a perspective view of the assembled portable computer and the supporting attachment structure with the portable computer in the open position.

The portable computer collapsable supporting attachment structure consists, referring to FIG. 1, of a telescopable and foldable structural member 1 on which is positioned and fastened a portable computer 2 with a body and keyboard unit 3 and with a display 4, shown in the open position. The portable computer 2 and structural member 1 assembly 5 is movably supported on a plurality, of which three of four are partially visible in this view, of broad area resilient strap members 6 that pass over the upper legs, not shown, of the user when the user is in the seated position, and which attach to foldable side elements 7, 8, and center member 9 of the structural member 1 and which in turn, in use are, on the outside of and between the, not shown, legs of the user. The foldability property of the side elements 7 and 8 is provided by hinges 10 and 11 respectively between the side elements 7 and 8 and telescoping support portions 12 and 13 respectively. The telescoping support portions 12 and 13 slide in and out of the structural member 1, to position, in use, the side elements 7 and 8 on the outside of the legs, not shown, of the user; and for collapse of the supporting attachment for storage and carrying, when not in use. The foldable properties of elements 7 and 12 through hinge 10 and elements 8 and 13 through hinge 11 permits the foldable side, 7 and 8, and center 9 members and the strap members 6 to also fold into a size comparable in thickness to the closed portable computer. The telescopable properties of the structural member 1 permits the side to side supporting dimension to be reduced for carrying to slightly greater than the side to side dimension of the portable computer. The portable computer can be removably attached to the retainer by means of velcro strips, not visible in FIG. 1.

A wrist support member 14 is attached to the structural member 1 with a bracket 15 that positions a padded portion 16 at the level of the keyboard 3 and serves as an operator stress relieving element in use, and as a carrying handle for the combined personal computer 2 with the telescoped and folded structural element 1 assembly.

The center foldable member 9 has strap retainer elements 21 of which only one is visible, on the lower edge for attachment of the strap members to be later described.

Figure 2:
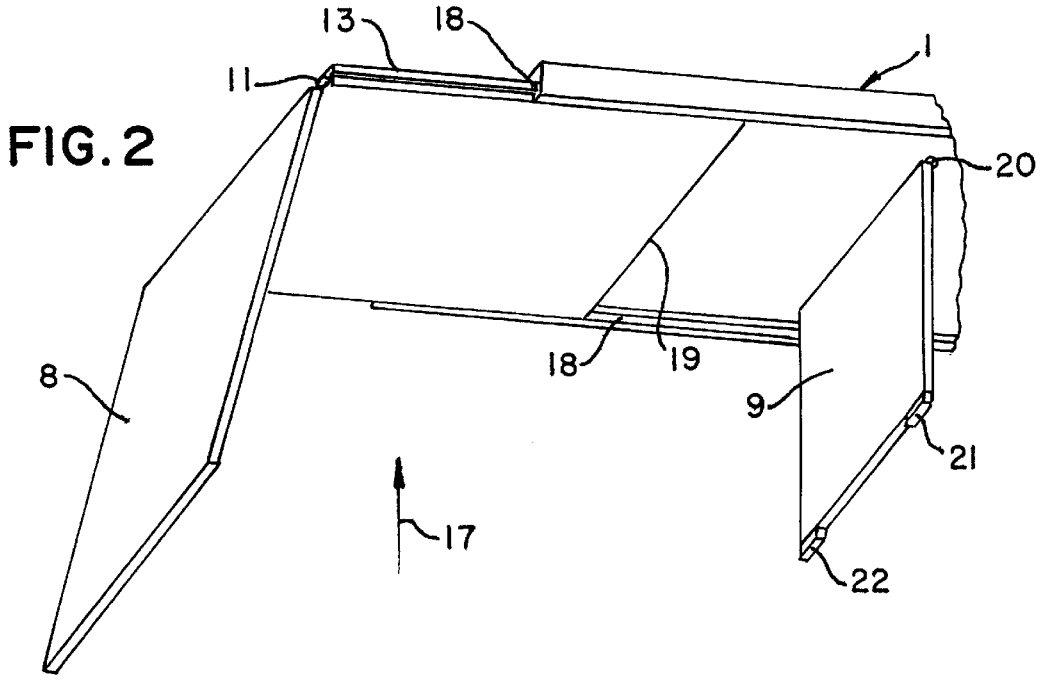
FIG. 2 is a perspective view of the bottom of a portion of the structural member assembly along a direction indicated by an arrow illustrating the folding properties of one side and the center foldable elements; and the telescoping properties of the structural member assembly.

Referring to FIG. 2 there is shown a perspective view of the implementation of the folding and the telescoping properties of the structural member 1 in the invention. In FIG. 2, wherein like reference numerals as in FIG. 1 are used where appropriate, a perspective view along the arrow 17 of a a portion of the underside of the structural member 1 is provided that shows the telescoping support portion 13 sliding into grooves 18 in the structural support member 1 in telescoping into the minimal side by side dimension when the edge 19 of the element 13 is in the vicinity of the center foldable member 9. The opposite portion involving the remainder of structural element 1 with element 12 sliding into it is constructed and operates as that shown.

The element 13 can slide out of the groove 18 far enough to position the side foldable member 8 at the side of the legs of the user. The hinges 10 and 11 can be provided with a travel limiting ridge, not shown, that will stop rotation at a position where the side foldable elements 7 and 8 are at a sightly greater than a ninety degree angle with respect to elements 12 and 13 to facilitate seating of the supporting structure on the lap of the user.

The center foldable element 9 is attached through hinge 20 which has a stopping ridge that limits the hinge travel at about a ninety degree position with respect to the underside of the structural element 1. Element 9 will fold flat against the underside of element 1 with a, not shown, molded shape imparted to element 7 to accommodate element 9 when in the folded position when elements 7 and 8 are folded over into the minimal thickness dimension positions when the assembly is compressed.

On the edge of the center foldable element 9 there are strap retaining elements 21 and 22 in which ends of broad area resilient straps are retained.

Figure 3:
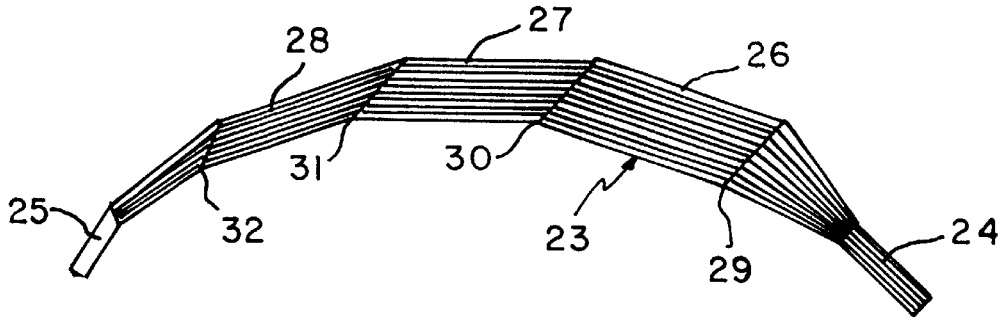
FIG. 3 is a perspective view of one of the plurality of the broad area resilient strap members.

Referring to FIG. 3 a perspective view is provided of the broad area resilient strap members 6 that are used to provide conformable support for the supporting structure while it is positioned on the lap of a user. The strap members 6 have a plurality of essentially parallel cord members 23, of a material such as nylon,that are compressible at locations 24 and 25 for feeding through retainers such as 21 and 22 and are spread into broad flat panels 26–28 by separators such as 29–32 of a material such as nylon.

Figure 4:
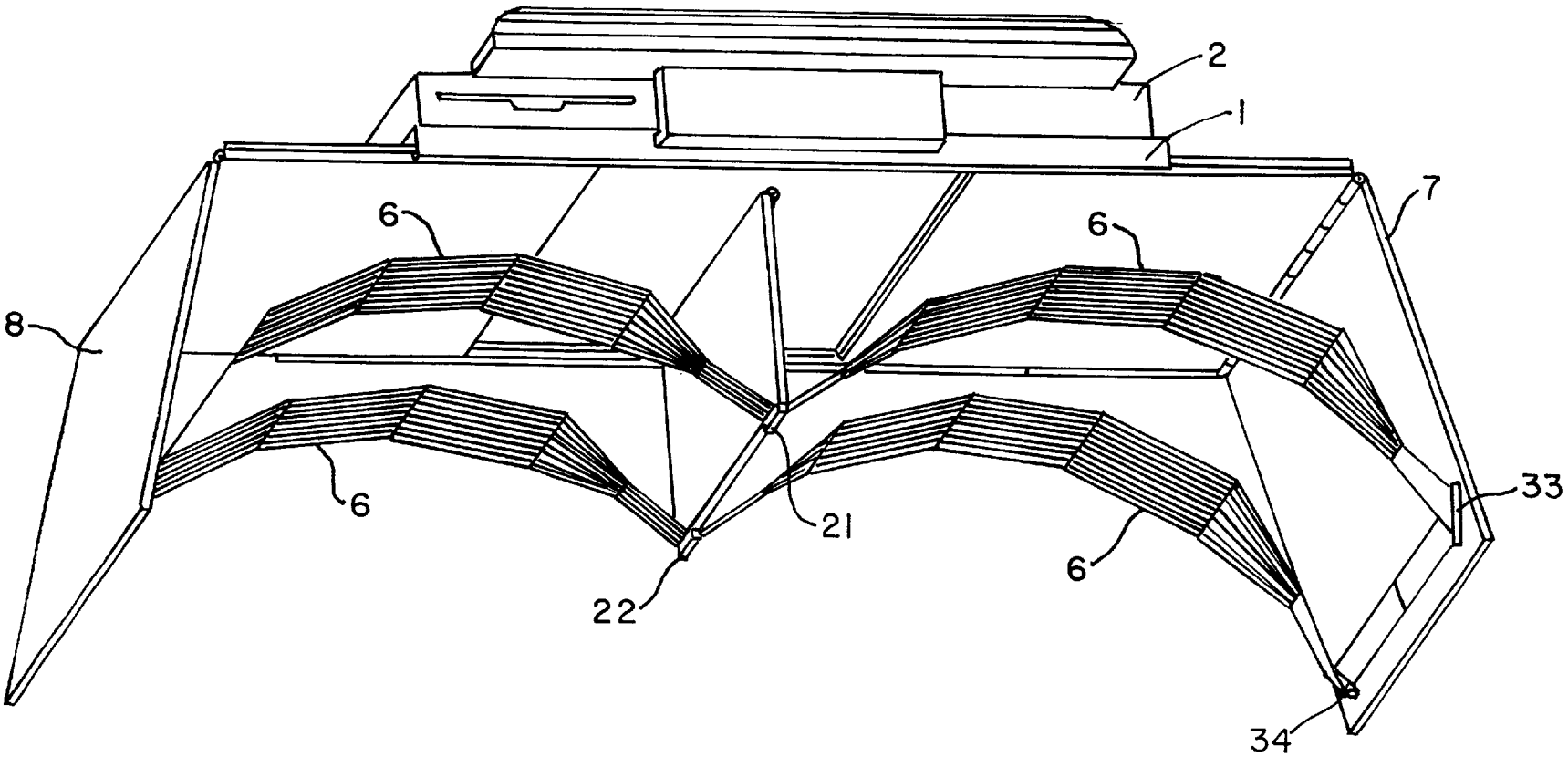
FIG. 4 is a perspective view of the bottom and front of the portable computer and supporting attachment assembly with the foldable side and center members, and broad area strap members, in position for use.

The broad area resilient strap 6 attachment is illustrated in connection with FIG. 4 wherein a perspective view of the front and bottom of the assembly is provided with the resilient broad area straps 6 visible. There is an advantage in using a single strap with four separate broad area portions 6 each with the compressed reduced width regions threaded through six retainers 21, 22, 30, and 31 and two on the foldable side element 8 that are out of view in this figure.

The retainer pairs 33 and 34 on element 7 and the two that are out of view on element 8 are set at forty five degrees to the edge of the element. The single strap with the four broad area portions then operate together with the parts of the strap self adjusting through the diagonally positioned retainers thereby producing stability when the assembly is on the user's lap. Adjustment of the straps is furthered by lifting the assembly which permits the straps to conform to the user. The retainers are knurled to dampen strap shifting.

The single continuous strap arrangement provides two pairs of broad area resilient strap supports for the desk assembly when in use. There is one pair of straps over each of the side by side upper legs of the user. The arrangement provides stability during any fidgiting motion of the user while in the sitting position, any background motion of the workplace location, and user comfort.

Figure 5:
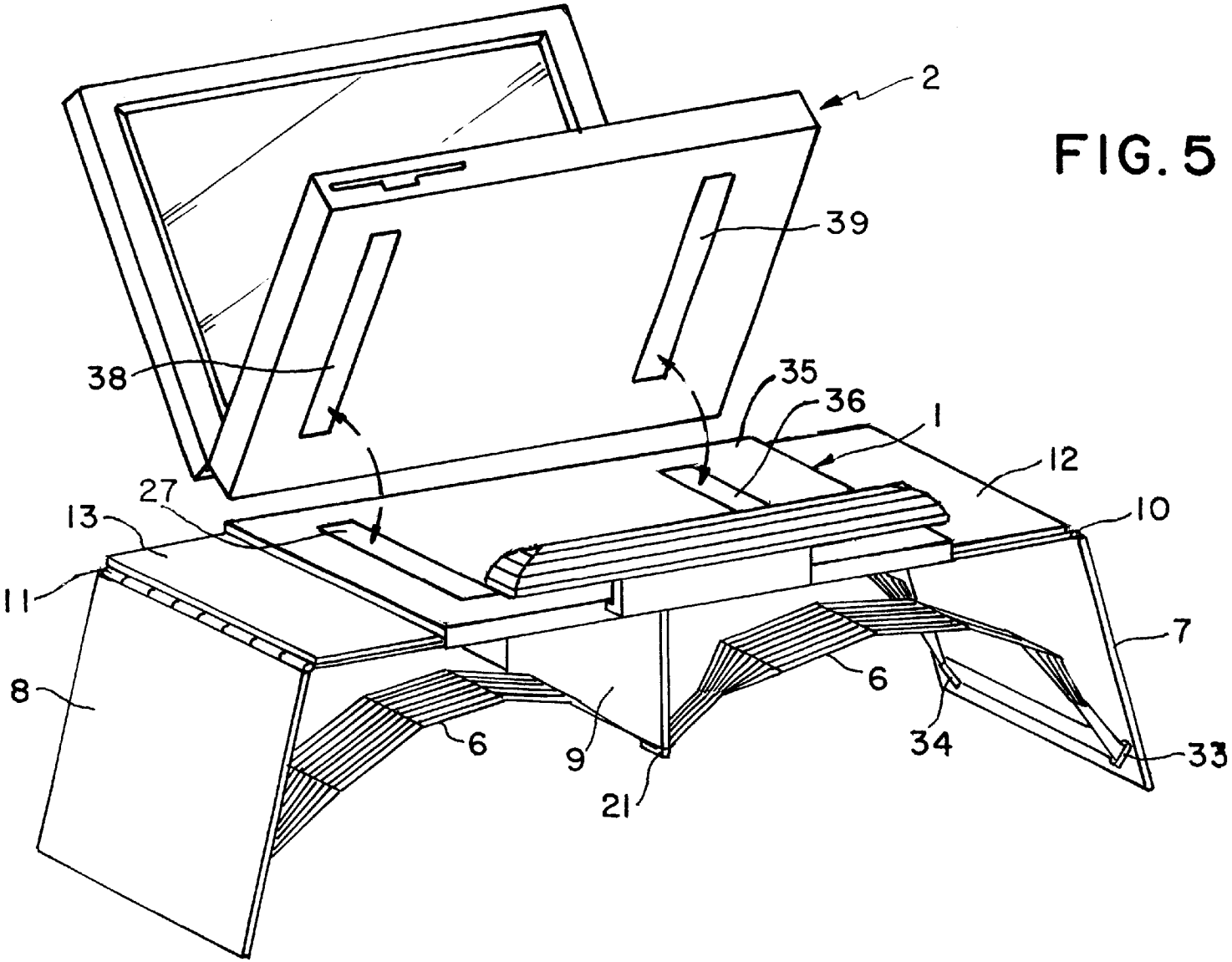
FIG. 5 is a perspective view of the front of the portable computer and telescopable and foldable structural element assembly with the portable computer shown rotated to expose a view of the velcro strip retention means attaching the portable computer to the top surface of the telescopable and foldable structural member.

The portable computer 2 is attached to the flat upper surface 35 of the foldable and telescopable structural member 1 preferably by a low profile adhesive means such as the material velcro. The manner of attachment is illustrated in FIG. 5 which is a perspective view of the portable computer 2 and structural element 1 assembly with the portable computer 2 shown rotated away from the surface 35 to expose the velcro strips 36–39 which retain the portable computer 2 in position on the surface 35 while having a sufficiently low profile that the computer ports remain compatible with any docking station. It will be apparent that any manner of attachment that is clean, low profile, durable and readily separable will suffice for the attachment.

Figure 7:
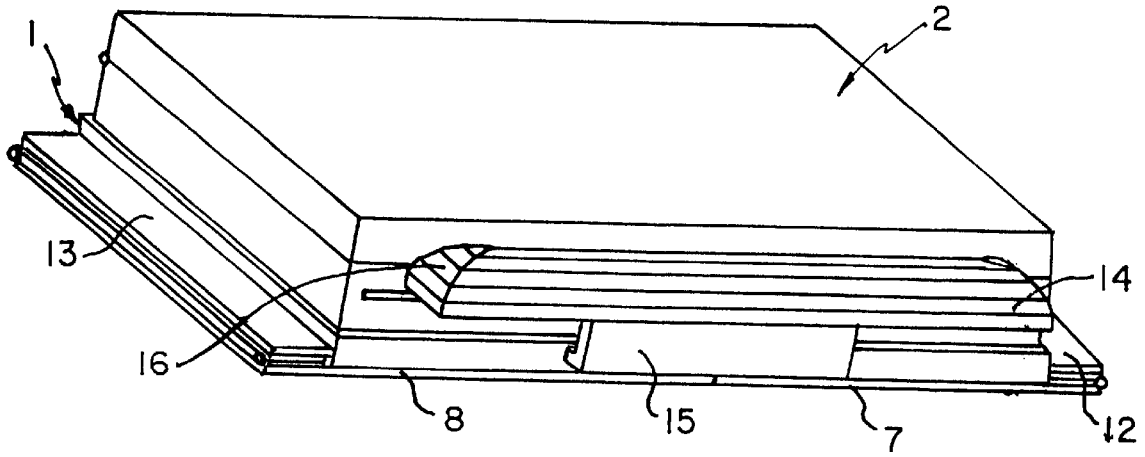
FIG. 7 is a perspective view of the assembled portable computer and the supporting attachment structure in the compressed and carrying position.
Figure 6:
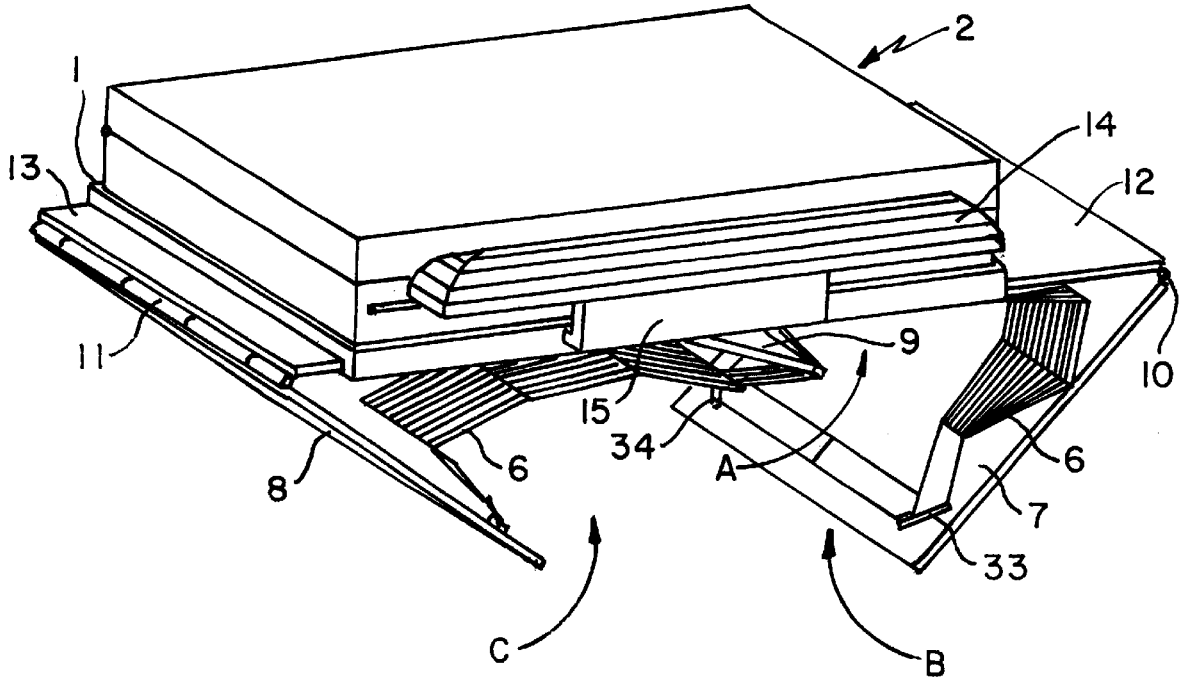
FIG. 6 is a perspective view of the bottom and front of the portable computer and structural member assembly with the foldable side and center members and broad area strap members in a partially folded and compressed position.

When the assembly is to be closed into a compact package for carrying or storage, the telescopable and foldable members fold together as illustrated in FIG. 6 into the package illustrated in FIG. 7.

Referring to FIG. 6 the assembly is shown with the foldable side members 7 and 8 and the foldable center member 9 in a partial folded position. The folded center member 9 moves in the direction of the arrow A from the vertical position when the assembly is in use to a position flat against the underside of the member 1. The foldable side member 7 moves in the direction of the arrow B into a position over the center member 9 and parallel to the underside of the structural member 1. The foldable side member 8 moves in the direction of the arrow C into a position parallel to the underside of the structural member 1. The straps 6 are attached so as to fold in segments that stay inside the side members 7 and 8 when they are folded together. When folded together the members 7 and 8 are in contact and stay closed by the friction.

Referring to FIG. 7 which shows the portable computer 2 and structural member 1 assembly in a compressed compact package. In the compressed condition the structural member assembly is slightly larger in area than the portable computer 2 by the portions of elements 12 and 13 remaining exposed after telescoping. The wrist rest element 14 is held away from the computer 2 by the bracket 15 attached to the structural member 1 so that a convenient carrying handle is provided.

In order to provide a starting place for one skilled in the art in practicing the invention the following exemplary specifications are advanced.

The portable computer attachment of the invention may be constructed of standard materials in the art such as metal and plastic with usually metal fittings, a neoprene wrist pad and nylon strapping. The body of the portion with the upper surface 35 is of moldable plastic and is about the area size of a portable computer which is about 9 inches by twelve inches. The member 1 is molded with grooves 18 to permit the slidable telescoping supporting portions 12 and 13 to slide in and out about 4 inches. The side members 7 and 8 are about 9 inches by 6 inches. The hinges 10 and 11 permit each member 7 and 8 to form, at a stop, an about a 105 degree angle with the underside of the element 1. The center member 9 is about 9 inches by 8.5 inches by 4 inches. The wrist rest element 14 is about 10 inches by 1.5 inches with an about 0.5 inch thick neoprene pad.

What has been described is a supporting attachment structure for a portable computer that provides desk like support for the computer in position for comfortable use on the lap of a seated portable computer user and which may be compressed into a convenient size package.

What is claimed is:

1. An attachment for a portable computer comprising in combination:

an essentially rectangular structural member having a front and a rear face, first and second sides, an upper and a lower surface, and a groove on the inside of each of said front and rear faces that will accommodate sliding a flat portion of a foldable member into each of said first and second sides, means for attaching the bottom surface of a portable computer to said upper surface of said structural member in an orientation where the keyboard of said portable computer is adjacent to said front face of said structural member, first and second side members, each having a flat first portion at least partially positioned in and supported by said grooves in said front and rear faces, and each having a hinged folding portion that movably holds said folding portion in a position ranging from flat against said flat first portion to approximately perpendicular to said flat first portion, a center member attached through a hinge to an essentially center location on said underside of said structural member, and, a multiple broad area strap assembly of two parallel straps each having a broad area portion between one folding portion of one said side member and said center member and having an end of each broad area member retained at a corner of a foldable member and a center member.

2. The attachment for a portable computer of claim 1 including a wrist support member attached to said front face of said structural member.

3. The attachment for a portable computer of claim 1 wherein said a multiple broad area strap assembly of two parallel straps includes two broad area portions in each strap with in each strap, one of said two broad area portions being positioned between a side member and said center member.

4. The attachment for a portable computer of claim 3 wherein said a multiple broad area strap assembly is of a nylon web.

5. The attachment for a portable computer of claim 3 wherein said means for attaching the bottom surface of a said portable computer to said upper surface of said structural member is by velcro strips.

6. A laptop portable computer desk for use resting on the upper legs of a seated user, comprising in combination:

a structural member, on which on an essentially flat upper surface, a portable computer is positioned with the keyboard of said portable computer at an edge of said structural member next to said user, said structural member being supported, on a lower side next to said legs of said user, by foldable side and center pieces each hingedly attached to said lower side of said structural member along a first edge, each of said side pieces being adapted to telescope into said structural member and fold out to an essentially perpendicular position with respect to said structural member that is next to said upper legs of said user, and said center piece of said foldable pieces being adapted to fold out to an essentially perpendicular position with respect to said structural member and into a position between said upper legs of said user, said structural member further being resiliently positioned above said upper legs of said seated user through a multiple strap supporting harness, that passes over and rests on, said upper legs of said seated user, said multiple strap supporting harness being attached along a second edge of each of said foldable pieces opposite to and parallel to said first hinged edge.

7. A portable computer desk for use on the lap including the upper legs of a seated operator, comprising in combination:

a structural member having an essentially flat upper surface for attachment of a portable computer, and, a resilient supporting assembly for flexibly positioning said structural member with said portable computer at a location above and separated from said upper legs of said operator, said resilient supporting assembly including offsetting members extending toward said upper legs of said operator a first distance away said structural member, said resilient supporting assembly further including a conformable web member for passing over said upper legs of said operator the ends of said web member being attached to each of said offsetting members at said first distance away from said structural member, and, said conformable web member having a length operable to position said structural member at a second distance above said upper legs, said second distance being less than said first distance.

8. The portable computer desk of claim 7 wherein there are a center and two side offsetting members and said conformable web member is a plurality of broad area segments with at least one segment between each said side member and said center member.

9. The portable computer desk of claim 8 including a telescoping and folding capability for the combination of said structural member and said side offsetting members whereby said side offsetting members can slide into said structural member and can fold parallel to said structural member.

* * * * *